United States Patent [19]

Hampel et al.

[11] Patent Number: 4,735,160

[45] Date of Patent: Apr. 5, 1988

[54] CUTTING DEVICE FOR A SEWING MACHINE

[76] Inventors: Klaus Hampel, Oerkenweg 38, D-4800 Bielefeld 15; Reinhold Schrudde, Dalbker Strasse 26a, D-4811 Oerlinghaus-Lipperreihe, both of Fed. Rep. of Germany

[21] Appl. No.: 70,915

[22] Filed: Jul. 8, 1987

[30] Foreign Application Priority Data

Jul. 23, 1986 [DE] Fed. Rep. of Germany ..... 3624933

[51] Int. Cl.[4] ..... D05B 37/04; D05B 65/00; D05B 83/00

[52] U.S. Cl. ..... 112/288; 112/292; 112/301; 112/261

[58] Field of Search ..... 112/288, 285, 292, 295, 112/298, 301, 261

[56] References Cited

U.S. PATENT DOCUMENTS

| | | | |
|---|---|---|---|
| 1,580,005 | 4/1926 | Bray | 112/261 |
| 1,939,620 | 12/1933 | Ciravolo | 112/261 |
| 3,111,921 | 11/1963 | Kleemann et al. | 112/261 |
| 3,633,526 | 1/1972 | Fay | 112/288 X |
| 4,281,607 | 8/1981 | Torre | 112/130 |

FOREIGN PATENT DOCUMENTS 2719894 11/1978 Fed. Rep. of Germany .

*Primary Examiner*—H. Hampton Hunter

*Attorney, Agent, or Firm*—Laff, Whitesel, Conte & Saret

[57] ABSTRACT

A cutting device for a sewing machine is provided with a cutting instrument associated to a cutting zone. The cutting instrument is formed with a blade movable towards the cutting zone. Furthermore, a protective guard is provided with a blade cover surrounding the blade, movable from an inoperative position spaced apart from the cutting zone to a position in front of the cutting zone. The blade and the blade cover are drivable in such a manner that the blade is only movable towards the cutting zone after the blade cover has been moved in front of the cutting zone. In order to reliably position the blade cover in front of the cutting zone prior to the movement of the blade to the cutting zone for performing the cutting operation, a mechanical locking mechanism is provided for the blade, which is only released when the blade cover is positioned in front of the cutting zone. The blade cover is non-positively connected to its drive in order to prevent injuries by the blade cover.

6 Claims, 4 Drawing Sheets

Fig. 2
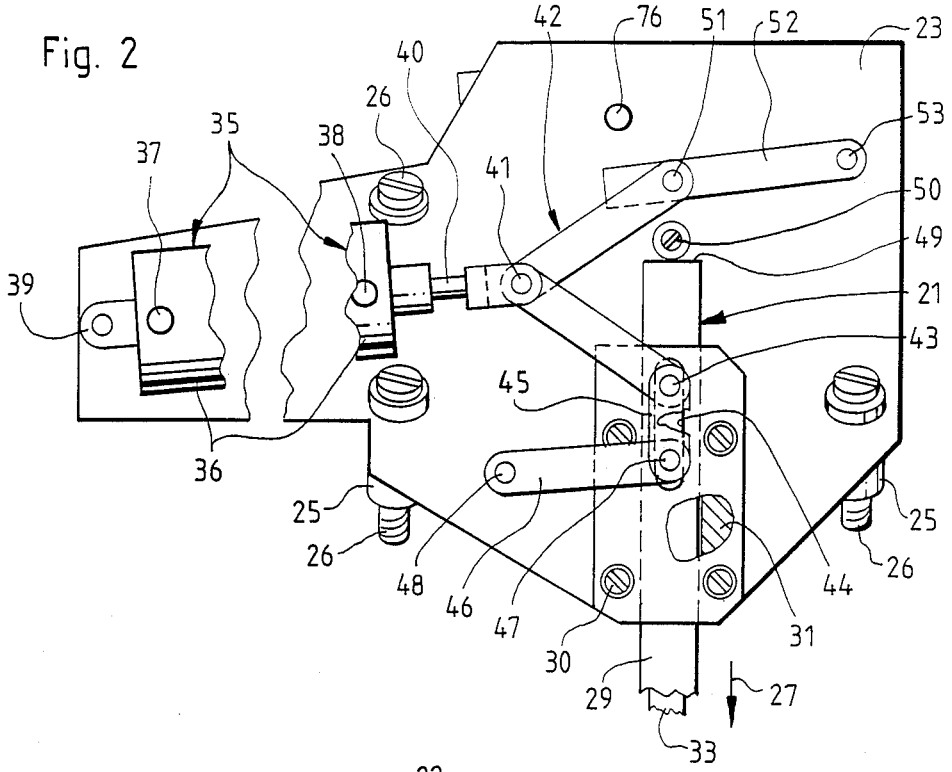
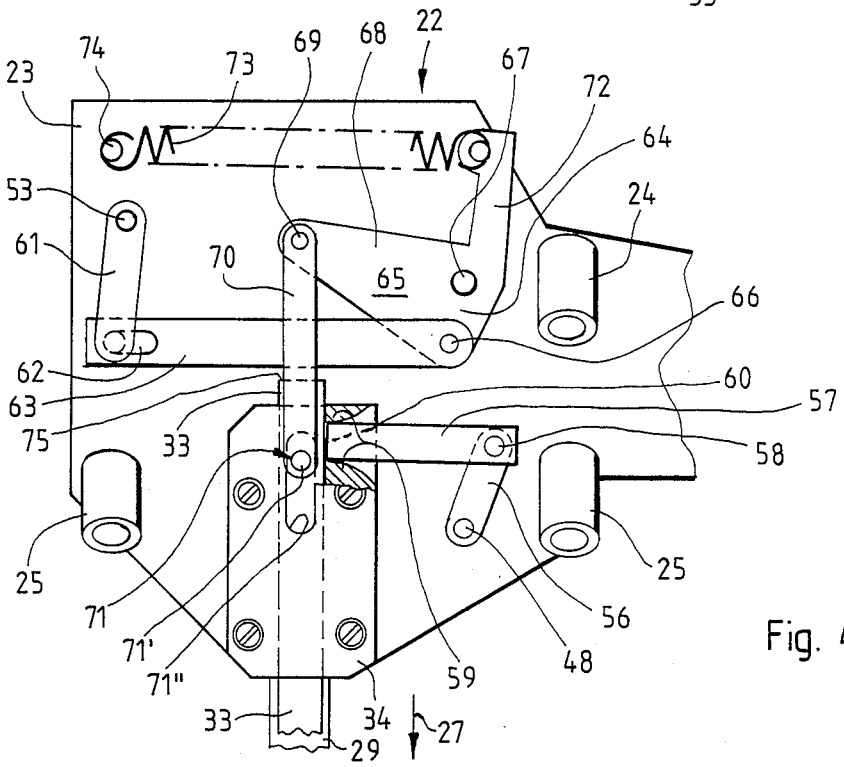
Fig. 4

CUTTING DEVICE FOR A SEWING MACHINE

FIELD OF THE INVENTION

In general this invention relates to a cutting device for a sewing machine. In particular, the cutting device for the sewing machine including a stitch forming area has a cutting zone arranged with respect to a workpiece feeding direction behind the stitch forming area, a cutting instrument with a blade movable from an inoperative position distant from the cutting zone to the cutting zone, and a protective guard with a blade cover surrounding the blade and movable from an inoperative position distant from said cutting zone to a position close to the cutting zone. The blade and the blade cover are drivable in such a manner that the blade is only movable to said cutting zone after the blade cover has been moved to its position close to the cutting zone.

BACKGROUND OF THE INVENTION

U.S. Pat. No. 4,281,607 shows a cutting device of such type wherein the blade on the one hand and the blade cover on the other hand are separately driven by separate drives in form of pneumatically operated piston-cylinder-drives. The actuation of these drives is accomplished in such a manner, that at first the blade will be moved to the cutting position if the blade guard has been moved in a position close to the cutting zone, so that the operator cannot get his fingers into the operating path of the blade. Such an electric sequential control for operating the piston-cylinder-drives includes the risk of malfunctions. Moreover, the required separate drive for the blade guard includes additional risk of injury due to its dimensioning and operation.

German Offenlegungsschrift No. 27 19 894 shows a cutting device for a sewing machine, wherein a blade is driven via a toggle mechanism, an intermediate joint of which is drivably connected to a piston rod of a pneumatically operated piston-cylinder-drive. While one end of the toggle mechanism is linked to the blade, the other end of the toggle mechanism is stationarily suspended. Upon one single motion of the piston rod in one direction the blade will be moved from an upper inoperative position towards a counter knife while performing the cutting process, wherein the latter is achieved in a stretched position of the toggle mechanism. Upon further linear motion of the piston rod the toggle mechanism is kinked in or folded again, i.e. the blade is restored into its upper inoperative position.

SUMMARY OF THE INVENTION

It is a main object of the invention to provide a cutting device of the type described above, wherein the blade guard is reliably positioned close to the cutting zone, prior to the movement of the blade itself to the cutting zone for performing the cutting process.

It is a further object of the invention to provide a cutting device which operates reliably.

It is still a further object of this invention is to provide a cutting device wherein the motion of the blade guard itself does not lead to injuries when through carelessness the operator gets his fingers in the way of motion of the blade cover.

It is still a further object of the invention to provide a cutting device which excludes malfunctions when seperate drives are used.

Moreover, it is an object of this invention to provide a cutting device which is simple in design and inexpensive to manufacture.

The main object of the invention is achieved by providing a mechanical locking for the blade, said locking being only released when the blade cover is in its position close to the cutting zone.

Numerous further advantages and features of the invention will be obvious from the description of an embodiment with reference to the drawing.

BRIEF DESCRIPTION OF THE DRAWING

FIG. 2 is a top plan view of the cutting instrument of the cutting device according to the arrow II in FIG. 1, on an enlarged scale;

FIG. 4 is a view of the protective guard of the cutting device according to the arrow III in FIG. 1, on an enlarged scale;

DETAILED DESCRIPTION OF EMBODIMENT

Figure 1:
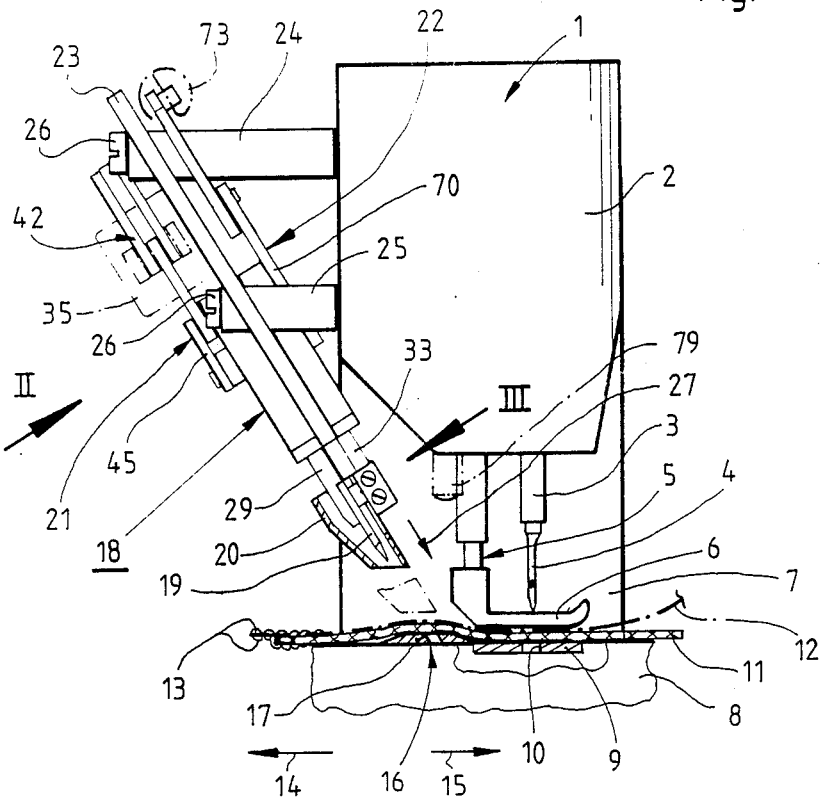
FIG. 1 is a view of the head of a sewing machine showing a cutting device according to the invention.
Figure 3:
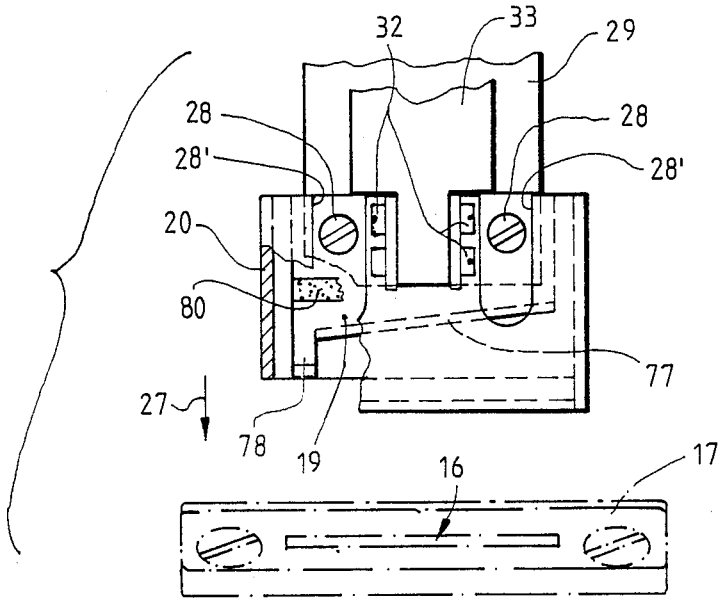
FIG. 3 is a partial view of the cutting device according to the arrow III FIG. 1, on an enlarged scale.

FIG. 1 refers to a sewing head 1 of a sewing machine, in the upper arm 2 of which a needle bar 3 with a needle 4 and, parallel with the needle bar 3 a presser foot bar 5 with a presser foot 6 are drivably supported in usual manner. The upper arm 2 of the sewing head 1 is connected to a lower arm 8 via a standard 7. A throat plate 9 having a stitch hole 10 is arranged on the upper surface of the lower arm 8 and below the needle 4. A hook (not shown) is located below the throat plate 9, which hook forms stitch forming instruments together with the needle 4. For the purpose of simplification, the area around the stitch hole 10 is hereinafter designed as stitch forming area.

By means of the sewing head 1 individual workpieces 11, e.g. upholstery cuts, are sewn together with a continuously fed material 12, e.g. a ribbon, a braid, a piping, with a thread chain 13 being generated in the stitch forming area connecting the workpieces 11 with the continuously fed material 12. The feed direction 14 of the workplace extends from the needle 4 to the presser foot bar 5 (in FIG. 1 to the left side), while the sewing direction 15 extends oppositely (in FIG. 1 to the right side), i.e. from the presser foot bar 5 to the needle 4.

In the feed direction 14 of the workpieces directly behind the presser foot 6 a cutting zone 16 is arranged, where the continuously fed material 12 may be severed, so that the individual workpieces 11 each are connected to a corresponding section of the continuously fed material 12. Of course, also the thread chain 13 is severed, which is generated during the sewing procedure. If only individual workpieces are continuously sewn, only the thread chain 13 can be severed, too.

In the cutting zone 16 a stationary counter blade 17 of a cutting device 18 is mounted on the lower arm 8. The counter blade 17 substantially flushes with the throat plate 9.

The cutting device 18 is provided with a blade 19 cooperating with the counter blade 17, and a sleeve-shaped blade cover 20 surrounding the blade 19. The blade 19 is a component of a cutting instrument 21. The drivable blade cover 20 is a component of a protective guard 22. The cutting instrument 21 is mounted on one surface of a supporting plate 23, while the protective guard 22 is arranged on the other surface. The supporting plate 23 is provided with fastening lugs 24, 25 formed as spacers, which allow an inclined mounting of the supporting plate 23 on the upper arm 2 of the sewing head 1 by means of screws 26. The supporting plate 23 is mounted on the arm 2 in an inclined manner relative to the vertical so that the direction of movement 27 of the blade 19 and the blade cover 20 extends below the arm 2 towards the counter blade 17 very close behind the stitch hole 10.

The blade 19 is interchangeably secured to a guide rod 29 by means of two screws 28. In the area of the screws 28 the blade cover 20 is provided with clearance cuts 28' in order to allow an unobstructed movement of the blade 19 relative to the blade cover 20. The guide rod 29 is received with clearance in a slide bearing 30, so that the guide rod 29 together with the blade 19 is linearly displaceable in the direction of movement 27. The guide rod 29 has a non-circular, preferably rectangular profile matching with the profile of the slide bearing 31, so that the guide rod 29 and thus the blade 19 may not rotate.

In the same manner the blade cover 20 is secured to a guide rod 33 by means of screws 32. The guide rod 33 is displaceably and non-rotatably received in a slide bearing 34 located on the other surface of the supporting plate 23, and extends in parallel with the guide rod 29.

For the purpose of driving in common the cutting instrument 21 and the protective guard 22 a linear drive 35 is provided formed as a double-acting pneumatic-piston-cylinder drive the movement of which acts via a system of lever drives upon the guide rod 29 on the one hand and upon the guide rod 33 on the other hand. Due to this movement first the blade cover 20 is displaced downwards in a position closely above the cutting zone 16 and then the blade 19 is displaced downwards into the direction 27 in order to perform the cutting movement.

The drive 35 usually includes a cylinder 36 having two compressed air connections 37, 38. One end of the cylinder 36 is fastened to the supporting plate 23 via a tilt bearing 39. The piston rod 40 of the drive 35 is guided through the end of the cylinder 36 which is opposite to the tilt bearing 39. The free end of the piston rod 40 is hinged to a toggle joint 41 of a toggle lever 42. Due to the connection of the drive 35 to the tilt bearing 39, the drive may perform the movements of the toggle joint 41 of the toggle lever 42, which movements extend perpendicularly to the longitudinal direction of the piston rod 40 and in parallel with the supporting plate 23. The lower free end of the toggle lever 42 is connected to the guide rod 29 via an intermediate link joint 43. In order that the link joint 43 can perform the movements of the guide rod 29 in the direction of movement 27, the slide bearing 31 is formed in the area of movement of the link joint 43 with a corresponding oblong hole 44.

A tie rod 45 is hinged to the link joint 43 and extends downwards and in parallel with the guide rod 29. To the other end of the tie rod 45 a lever 46 is hinged by means of a link joint 47. The end of the lever 46 opposite to the link joint 47 is non-rotatably connected to a locking shaft 48, which is supported in and guided through the supporting plate 23. The guide rod 29 is formed with an upper stop surface 49 which, in the upper inoperative position of the blade 19 as illustrated in FIGS. 1 and 2, rests against a limit stop 50 stationarily connected to the supporting plate 23, so that the path of the guide rod 29 opposite to the direction of movement 27 is limited or limitable.

The other, i.e. the upper free end of the toggle lever 42 is connected to a tilt lever 52 via a link joint 51. The end of the tilt lever 52 arranged opposite to the link joint 51, is non-rotatably connected to a drive shaft 53 for the blade cover 20. The drive shaft 53 is supported in and guided by the supporting plate 23. A stop 76 is fastened to the supporting plate 23 limiting the tilt area of the tilt lever 52. As illustrated in FIGS. 5*a* to 5*d*, the locking shaft 48 is supported in the supporting plate 23 by means of two bearings 54, while the drive shaft 53 is supported by means of two bearings 55.

The afore-described lever mechanism is located on the side of the supporting plate 23 as illustrated in FIG. 2 and associated to the cutting instrument 21.

The hereinafter described portion of the lever meachnism driven by the two shafts 48, 53 is located on the side of the supporting plate 23 associated to the protective guard 22 as illustrated in FIG. 4. In FIGS. 5*a* to 5*d* this portion of the lever mechanism is illustrated by partially black filled double lines.

A lever 56 is non-rotatably secured to the locking shaft 48, to the other end of which lever is hinged a locking slide 57 by means of a link joint 58. Upon corresponding tilt movements of the shaft 48 the locking slide 57 is displaceable in a guide 59 in an approximately perpendicular direction relative to the direction of movement 27 of the guide rod 33. The guide 59 is formed as an opening in the slide bearing 34. In the upper inoperative position of the protective guard 22 as illustrated in FIGS. 1 and 4, the free end 60 of the locking slide 57 rests laterally against the guide rod 33.

A crank 61 is non-rotatably secured to the drive shaft 53 of the blade cover 20 and is connected to a tie rod 63 via a pivot connection 62. The tie rod 63 is connected to the lower arm 64 of a triangular lever 65 via a pivot 66. The triangular lever 65 is tiltably supported on the supporting plate 23 via a stationary intermediate tilt bearing 67. A lateral arm 68 of the triangular lever 65 is hingedly connected to a tie rod 70 via a pivot 69. The tie rod 70 extends downwards and nearly in parallel with the guide rod 33 and is hinged to the latter via a pivot 71. The pivot 71 is formed with a lug 71' projecting with clearance through an oblong hole 71" of the slide bearing 34, and is secured to the guide rod 33.

A tension spring 73 is fastened the upper arm 72 of the triangular lever 65, extending nearly perpendicularly relative to the direction of movement 27. The other end of the tension spring 73 is stationarily supported in a bearing 74 located at the supporting plate 23. The tension spring 73 acts in a direction moving the guide rod 33 downwards in the direction towards the stitch forming area in the area of the stitch hole 10. With reference to the graphic illustrations in FIGS. 5*a* to 5*d* the tension spring acts in clockwise direction.

The upper free end of the guide rod 33 serves as an unlocking and locking surface 75. When the guide rod 33 together with the blade cover 20 is located in the lower position as shown in FIG. 1 in a dot-dash line, the free end 60 of the locking slide 57 may move over the unlocking and locking surface 75, by which on the one hand the blade cover 20 is locked in its lower operative position and by which on the other hand the guide rod 33 together with the blade 19 is unlocked.

Operation of the cutting device 18 is hereinafter described starting from an inoperative position as illustrated in FIGS. 1 to 4 and 5*a*, in which the toggle lever 42 has an angular opening of about a=68°.

Figures 5A, 5B:
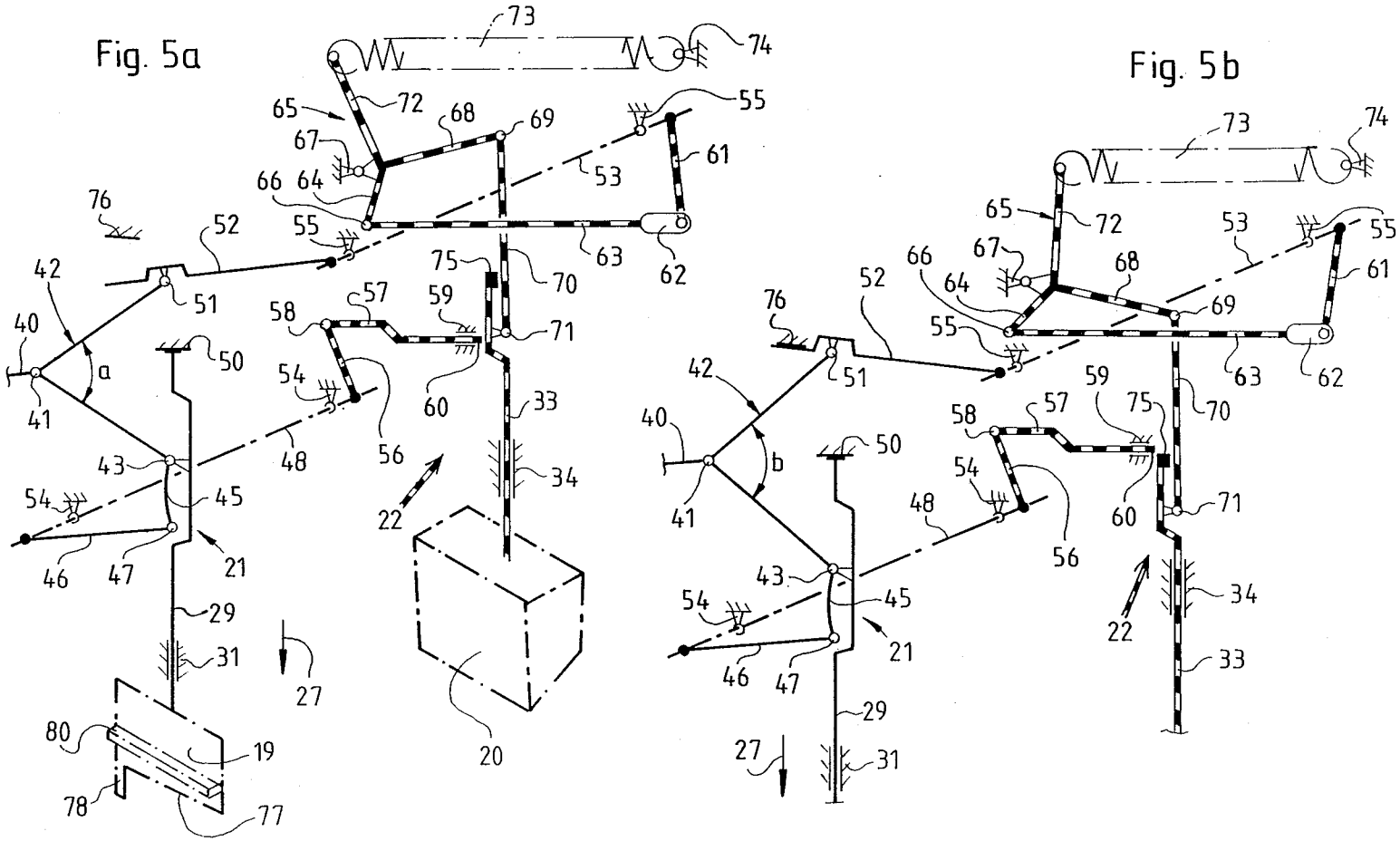
FIG. 5*a* is a kinematic diagram of the cutting device according to the invention showing the blade and the blade cover in an upper inoperative position, wherein the drive of the blade is illustrated in full lines and the drive of the blade cover is illustrated in dotted lines.
FIG. 5*b* is a kinematic diagram according to FIG. 5*a*, wherein the blade cover is shown in its lower position, while the blade is still in its upper inoperative position.

When the linear drive 35 is actuated by the compressed air connection 37, so that the piston rod 40 is moved out of the cylinder 36, then the toggle lever 42 is stretched. This is only possible, when the upper tilt lever 52 is tilted while the drive shaft 53 is simultaneously rotated, until the free end of the tilt lever 52 rests against the stop 76. As the free end 60 of the locking slide 57 rests laterally against the guide rod 33, the locking shaft 48 is blocked. Thus, also the link joint 43 and the toggle lever 42 are blocked in this area via the lever 46 and the tie rod 45. For this reason, the guide rod 29 together with the blade 19 may not be moved downwards. By the rotation of the drive shaft 53 and the crank 61 it is rendered possible that the triangular lever 65 is rotated in clockwise direction due to the action of the tension spring 73. The guide rod 33 together with the blade cover 20 is displaced downwards, i.e. in the direction towards the counter blade 17. In case there is no obstacle between the cover blade 20 and the counter blade 17, the blade cover 20 is moved downwards in the direction towards the cutting zone 16 as far as the unlocking and locking surface 75 of the guide rod 33 releases the free end 60 of the locking slide 57. This position is illustrated in FIG. 5*b*. The opening angle b then amounts to approximately 80°. As the tilt lever 52 has come to rest against the stationary stop 76 connected to the supporting plate 23, the downward movement of the guide rod 33 is terminated and thus, a further movement of rotation of the drive shaft 53 is blocked. A further extension of the piston rod 40 now causes a tilting of the locking shaft 48 via the already described connections. Tilting of the shaft 48 is possible as the locking slide 57 can move over the unlocking and locking surface 75 of the guide rod 33. The guide rod 29 together with the blade 19 is moved downwards, i.e. into the counter blade 17, where the already described cutting operation takes place at the cutting zone 16. According to FIG. 5*c* the toggle lever 42 is in a stretched position. Consequently, its opening angle c amounts to about c=180°.

Figures 5C, 5D:
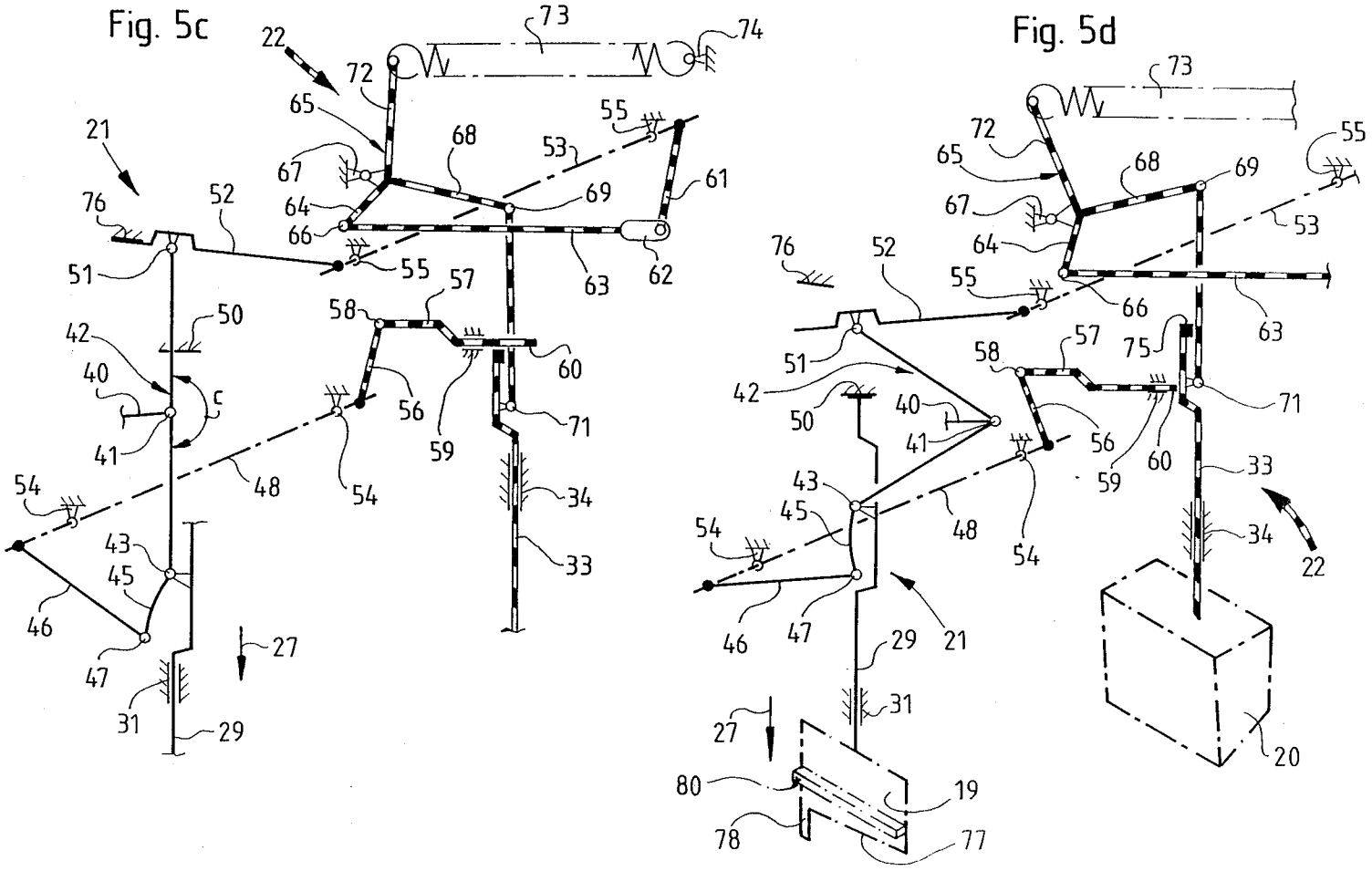
FIG. 5*c* is a kinematic diagram according to FIGS. 5*a* and 5*b*, wherein the blade cover is located in its lower position in front of the cutting zone and wherein the blade is located in its lower position at the cutting zone.
FIG. 5*d* is a kinematic diagram according to FIGS. 5*a* to 5*c*, wherein the blade cover and the blade again are located in their upper inoperative positions.

When the piston rod 40 is further extended, the toggle lever 42 again is tilted into a mirror-symmetrical position relative to FIG. 5*a* as illustrated in FIG. 5*d*. All other parts again take in their inoperative position as identically illustrated in FIGS. 5*a* and 5*d*, in which the blade cover 20 and the blade 19 are located in their upper position spaced apart from the cutting zone 16, and in which the blade 19 is surrounded by the blade cover 20. Due to this locking it is ensured that during the return stroke of the blade 19 and the blade cover 20, first the blade 19 and then the blade cover 20 are moved upwards. Thus, by only one single actuation of the linear drive 35, i.e. by only one continuous movement of the piston rod 40, the blade cover 20 may be moved downwards into its safety position in front of the cutting zone 16; subsequently a cutting operation may be performed and then first the blade 19 and then the blade cover 20 may be returned into their upper inoperative positions. An acutation of the cylinder 36 in a reverse direction via the compressed air connection 38 effects the same procedure, however according to FIGS. 5*d* to 5*a*.

If the downward motion of the blade cover 20 is hindered by an obstacle, e.g. a finger of the operator or carelessly placed scissors, the unlocking and locking surface 75 of the guide rod 33 does not reach the lowermost position, in which the locking slide 57 releases the blade 19. Here, the pivot connection 62 formed as an oblong hole, renders possible that the crank 61 is moved into its extreme end position due to the tilting of the tilt lever 52 towards the stop 76. This movement of the crank 61 is carried out by the given force of the linear drive 35. However, due to the pivot connection 62, the transmission via the triangular lever 65 to the guide rod 33 is only accomplished by the force of the tension spring 73. Consequently, the blade cover 20 may be stopped in a distance in front of the lower operative position, which distance is defined by the free length of the pivot connection 62 and the transmission ratios of the lever mechanism. The distance, in which the blade cover 20 may be stopped above the counter blade 17 only against the force of the tension spring 73, is so dimensioned that in any case there is some space in this area for a finger of the operator. When describing that in this area only the force of the tension spring 73 imparted to the blade cover 20 has to be absorbed, then the very small kinetic energy of the moved elements is being neglected.

With respect to the inclined cutting edge 77 the blade 19 is provided with a projecting wedge-shaped spur 78, which serves to guide the blade 19 when entering the counter blade 17. Subsequently, in the usual manner a drawing may be cut performed between the cutting edge 77 and the counter blade 17.

The illustrated and described mode of operation for bringing the blade 19 and the blade cover 20 to the cutting zone 16 and back into the inoperative position by means of one continuous movement of the piston rod 40 is recommendable, if at the beginning and at the end of the workpiece 11 the continuously fed material 12 and/or the thread chain 13 are to be severed.

In another mode of operation of the cutting device 18 it is possible that the blade 19 and the blade cover 20 remain in their lower positions. This is advantageous, if, for instance, two workpieces of uniform lengths are to be sewn together at their flushing edges and if the thread chain generated during the sewing operation is to be severed after sewing. In this case it is especially important that after the cutting operation is performed the free end of the thread chain is held until the thread chain is secured in the successive workpieces to be sewn. Holding of the thread chain end may then be achieved by an elastical holding member 80 secured to the blade 19 as to clamp the thread chain end at the counter blade 17. In this other mode of operation it is recommendable to dimension the stroke of the piston rod in such a manner that according to FIGS. 5*a* to 5*c* only one movement is possible, i.e. up into the stretched position of the toggle lever 42, whereupon the back movement is achieved by a separate actuation of the air connection 38. In principle, the control of the cutting operation or the cutting operations may be released by the operator or automatically via a light barrier 79.

In the lower position the blade cover 20 is spaced apart from the cutting zone 16 and the counter blade 17, respectively, in such a way that the workpieces 11 with the continuously fed material 12 can be advanced unobstructed below the blade cover 20, but that a finger of the operator cannot get into the path of motion of the blade 19. The minimum distance between the blade cover 20 and the counter blade 17 usually amounts to approximately 7 mm.

The sleeve-shaped blade cover 20 has such an extension in its direction of movement that the cutting edge 77 of the blade 19 is positioned inside of the blade cover 20 not only when the blade 19 and the blade cover 20 take in their upper inoperative positions, but when the blade cover 20 has already moved downwards above the cutting zone 16, while the blade 19 still takes in its upper position, as obvious from FIG. 5*b*.

What is claimed is:

1. A cutting device for a sewing machine having a stitch forming area and a workpiece feeding direction, including a cutting zone arranged in said workpiece feeding direction behind said stitch forming area; a cutting instrument, having a blade connected to a first drive for movement from an inoperative position distant from said cutting zone to said cutting zone; and a protective guard comprising a blade cover surrounding said blade and connected to a second drive for movement from an inoperative position distant from said cutting zone to a position close to said cutting zone wherein said blade and said blade cover are drivable in such a manner that said blade is only movable to said cutting zone by means of said first drive after movement of said blade cover by means of said second drive to its position close to said cutting zone; and a mechanical locking for said blade, said locking being only released, when said blade cover is in its position close to said cutting zone.

2. A cutting device according to claim 1, wherein said blade cover is non-positively connected to said second drive.

3. A cutting device according to claim 1, wherein a common drive is provided as said first drive and as said second drive which common drive is coupled by means of a first lever drive to said blade forming said first drive and by means of a second lever drive to said blade cover forming said second drive.

4. A cutting device according to claim 3, wherein said common drive is a linear drive acting upon an intermediate link joint of a toggle lever, having a lower free end and an upper free end, which ends are coupled to said lever drives.

5. A cutting device according to claim 1, wherein said mechanical locking includes a locking slide coupled to said blade, which is only movable towards said cutting zone when said blade cover is in said position close to said cutting zone.

6. A cutting device according to claim 5, wherein said blade cover is mounted to a guide rod, and wherein said locking slide rests against the guide rod thereby locking said blade and wherein means are provided for releasing said locking slide from said guide rod when said blade cover is in said position close to said cutting zone.

* * * * *